US008765659B2

(12) United States Patent
Gizaw et al.

(10) Patent No.: US 8,765,659 B2
(45) Date of Patent: Jul. 1, 2014

(54) CATIONIC POLYMER STABILIZED MICROCAPSULE COMPOSITION

(75) Inventors: Yonas Gizaw, West Chester, OH (US); Giulia Ottavia Bianchetti, Rome (IT); Karel Geert Claeys, Oostkamp (BE); Jean-Francois Bodet, Waterloo (BE); Olav Pieter Dora Tony Keijzer, Brussels (BE); Denise Malcuit Belanger, West Chester, OH (US); Lon Montgomery Gray, Florence, KY (US); Peter Marie Kamiel Perneel, Bruges (BE)

(73) Assignee: The Procter & Gamble Company, Cincinnati, OH (US)

( * ) Notice: Subject to any disclaimer, the term of this patent is extended or adjusted under 35 U.S.C. 154(b) by 338 days.

(21) Appl. No.: 13/078,059

(22) Filed: Apr. 1, 2011

(65) Prior Publication Data

US 2011/0245141 A1 Oct. 6, 2011

Related U.S. Application Data

(60) Provisional application No. 61/320,007, filed on Apr. 1, 2010.

(51) Int. Cl.
*C11D 3/37* (2006.01)
*C11D 3/50* (2006.01)

(52) U.S. Cl.
USPC ..... 510/438; 510/475

(58) Field of Classification Search
USPC ..... 510/438, 475
See application file for complete search history.

(56) References Cited

U.S. PATENT DOCUMENTS

| | | | |
|---|---|---|---|
| 4,081,384 | A | 3/1978 | Pracht |
| 4,234,627 | A | 11/1980 | Schilling |
| 4,514,461 | A | 4/1985 | Woo |
| RE32,713 | E | 7/1988 | Woo |
| 4,806,345 | A | 2/1989 | Bhattacharyya |
| 4,882,220 | A | 11/1989 | Ono et al. |
| 4,917,920 | A | 4/1990 | Ono et al. |
| 5,114,600 | A | 5/1992 | Biggin et al. |
| 5,145,842 | A | 9/1992 | Driedger et al. |
| 5,500,137 | A | 3/1996 | Bacon et al. |
| 5,500,138 | A | 3/1996 | Bacon et al. |
| 5,500,154 | A | 3/1996 | Bacon et al. |
| 5,574,179 | A | 11/1996 | Wahl et al. |
| 5,780,404 | A | 7/1998 | Bacon et al. |
| 6,194,375 | B1 | 2/2001 | Ness et al. |
| 6,200,949 | B1 | 3/2001 | Reijmer et al. |
| 6,491,728 | B2 | 12/2002 | Bacon et al. |
| 6,620,777 | B2 | 9/2003 | Heibel et al. |
| 6,645,479 | B1 | 11/2003 | Shefer et al. |
| 6,815,069 | B2 | 11/2004 | Hohberg et al. |
| 6,864,223 | B2 | 3/2005 | Smith et al. |
| 7,119,057 | B2 | 10/2006 | Popplewell et al. |
| 7,153,924 | B2 | 12/2006 | Kuepfer et al. |
| 7,321,019 | B2 | 1/2008 | Ziche |
| 7,427,648 | B2 | 9/2008 | Ochs et al. |
| 7,659,238 | B2 | 2/2010 | Martin et al. |
| 7,977,288 | B2 | 7/2011 | SenGupta |
| 2003/0045447 | A1 | 3/2003 | Heibel et al. |
| 2003/0158344 | A1 | 8/2003 | Rodriques et al. |
| 2003/0165692 | A1 | 9/2003 | Koch et al. |
| 2003/0195133 | A1 | 10/2003 | Shefer et al. |
| 2003/0203829 | A1 | 10/2003 | Shefer et al. |
| 2003/0215417 | A1 | 11/2003 | Uchiyama et al. |
| 2003/0216488 | A1 | 11/2003 | Uchiyama et al. |
| 2004/0071742 | A1 | 4/2004 | Popplewell et al. |
| 2004/0071746 | A1 | 4/2004 | Popplewell et al. |
| 2004/0072719 | A1 | 4/2004 | Bennett et al. |
| 2004/0072720 | A1 | 4/2004 | Brain et al. |
| 2004/0087477 | A1 | 5/2004 | Ness |
| 2004/0106536 | A1 | 6/2004 | Mane et al. |
| 2004/0204337 | A1 | 10/2004 | Corona et al. |
| 2005/0112152 | A1 | 5/2005 | Popplewell et al. |
| 2005/0153135 | A1 * | 7/2005 | Popplewell et al. ..... 428/402.2 |
| 2005/0202990 | A1 | 9/2005 | Caswell et al. |
| 2005/0245668 | A1 | 11/2005 | Green et al. |
| 2005/0256027 | A1 | 11/2005 | Heibel et al. |

(Continued)

FOREIGN PATENT DOCUMENTS

| | | | |
|---|---|---|---|
| EP | 1 393 706 | A1 | 3/2004 |
| GB | 1 579 007 | A | 11/1980 |

(Continued)

OTHER PUBLICATIONS

International Search Report; International Application No. PCT/US2011/030850; date of mailing Jun. 29, 2011; 5 pages.

Cationic polymeric thickeners useful in fabric softeners, Research Disclosure Database No. 429116, Jan. 1, 2000-Jan. 31, 2000, p. 136, XP-002646666, ISSN: 0374-4353.

Extended European Search Report; Application No./Patent No. 13183666.0-1358; dated Nov. 12, 2013; 8 pages.

* cited by examiner

*Primary Examiner* — John Hardee

(74) *Attorney, Agent, or Firm* — James F. McBride; Steven W. Miller

(57) ABSTRACT

The present invention relates to the use of a cationic polymer to provide stability to microcapsules in a composition, wherein the microcapsule comprises a shell encapsulating materials having an average C log P of at least 2.5 and more than 60% by weight of the encapsulated materials have a C log P of at least 3.3. The cationic polymer is derived from the polymerization of 5 to 100 mole percent of a cationic vinyl addition monomer, 0 to 95 percent acrylamide, and 5 to 500 ppm of a tetrafunctional vinyl addition monomer cross-linking agent. The cationic polymer and encapsulated material may be used, for example, in a fabric softener composition.

25 Claims, No Drawings

(56) References Cited

U.S. PATENT DOCUMENTS

| | | | |
|---|---|---|---|
| 2006/0074003 | A1 | 4/2006 | Martin et al. |
| 2006/0094639 | A1 | 5/2006 | Martin et al. |
| 2006/0287205 | A1 | 12/2006 | Popplewell et al. |
| 2007/0099817 | A1 | 5/2007 | Smith et al. |
| 2007/0275866 | A1 | 11/2007 | Dykstra |
| 2008/0305982 | A1 | 12/2008 | Smets et al. |
| 2009/0247449 | A1 | 10/2009 | Burdis et al. |
| 2011/0245142 | A1 | 10/2011 | Gizaw et al. |
| 2011/0271460 | A1 | 11/2011 | Karagianni et al. |

FOREIGN PATENT DOCUMENTS

| | | | | |
|---|---|---|---|---|
| WO | WO 9012862 | A1 | | 11/1990 |
| WO | WO 02/074430 | A1 | | 9/2002 |
| WO | WO 2004/016234 | A1 | | 2/2004 |
| WO | WO 2007/148274 | A2 | | 12/2007 |
| WO | WO 2008/005693 | A2 | | 1/2008 |
| WO | WO 2010/079100 | | * | 7/2010 |

CATIONIC POLYMER STABILIZED MICROCAPSULE COMPOSITION

CROSS-REFERENCES TO RELATED APPLICATIONS

This application claims priority under 35 U.S.C. §119(e) to U.S. Provisional Application Ser. No. 61/320,007 filed Apr. 1, 2010.

FIELD OF THE INVENTION

Consumer products having a cationic polymer stabilized microcapsule composition.

BACKGROUND OF THE INVENTION

Consumer products, such as fabric care products, personal care products and home care products are well known in the art and usually comprise one or more perfumes to impart the consumer product and/or a substrate treated or applied with the consumer product with a fragrance; however, these perfumes dissipate over time from the consumer product or substrate. Another problem with perfumes in consumer products is that they are released prior to an optimal delivery time, and the user of the consumer product is deprived of experiencing the perfume's fragrance. For example, it is desirable for a perfume to be present on clothes treated with a detergent and/or fabric softener long after such treatment, and there is a tendency for perfumes to evaporate or diffuse from the clothes over time.

Thus attempts have been made to minimize the loss of perfumes due to volatility and evaporation, and to optimize the release of the perfume's fragrance. One such approach has been to encapsulate the perfume within a shell to create a fragrance microcapsule.

The calculated log P (C log P) of many perfumes is known in the art, and has been reported, for example in the Ponoma92 database, available from Daylight Chemical Information Systems, Inc. (Daylight CIS) Irvine. Calif. Methods of calculating C log P are also known in the art. Perfumes with lower C log P values may be more volatile and exhibit higher aqueous solubility than perfumes having higher C log P values and are therefore preferred to be used in consumer products. However when lower C log P materials are encapsulated they may have a greater tendency to leach out of, or diffuse out of the shell into the consumer product (preventing optimal delivery of fragrances), and the perfumes may eventually diffuse out of the consumer product prior to use by the consumer.

Methods to prevent the leaching of perfumes from fragrance microcapsules have been developed. These may include coating the interior or exterior of the shell with one or more polymers or incorporation of stabilizing agents in the core. However, there is a continuing need to develop systems that deliver fragrances. More efficient delivery systems, or more stable encapsulated perfumes may result in more efficient use of perfumes, thus decreasing manufacturing costs.

When fragrance microcapsules are incorporated in consumer products containing solvents and/or surfactants, e.g., shampoos, stability problems may arise. The encapsulated perfume may leach out of the shell. The shell may also absorb a solvent, surfactant, or any other material in the consumer product, causing the shell's integrity to be compromised. The shell may swell because additional materials diffuse into the shell or the core, or the shell may shrink as materials of the core diffuse out of the shell. Indeed, components of the shell may even diffuse into the consumer product.

Similar considerations apply to the delivery using microcapsules of other materials providing benefits to the consumer, such as flavorants or antibacterial materials.

Thus there is a need to develop compositions suitable for use in compositions that provide for stability of microcapsules encapsulating fragrance or antimicrobial materials. WO 2008/005693.

In certain applications, also the deposition of encapsulated benefit agents is improved by coating the encapsulated benefit agent with a polymer. In general, such polymer coating improves the deposition of the encapsulates. Also surprisingly, while decreasing leaching of the PRM's out of the encapsulate when in the finished product, the polymer coating allows improved release of the PRM's in the headspace when the encapsulate is deposited on the surface to be treated.

SUMMARY OF THE INVENTION

In one embodiment the invention provides a composition comprising: a. a microcapsule comprising a shell encapsulating a material having an average C log P of at least 2.5 and more than 60% by weight of the material has a C log P of at least 3.3, and b. a cross-linked cationic polymer derived from the polymerization of about 5 to 100 mole percent of a cationic vinyl addition monomer 0 to about 95 mole percent acrylamide, and about 5 to about 500 ppm of a tetrafunctional vinyl addition monomer cross-linking agent and preferably a chain transfer agent from 100 ppm to 10,000 ppm selected from mercaptanes, malic acid, lactic acid, formic acid, isopropanol and hypophosphites, and mixtures thereof.

In another embodiment, the invention provides a method of improving the stability of a product that comprises at least one microcapsule comprising admixing with the product (before after, or simultaneously with the addition of the at least one microcapsule) a cross-linked cationic polymer derived from the polymerization of about 5 to 100 mole percent of a cationic vinyl addition monomer, 0 to about 95 percent acrylamide, and about 5 to about 500 ppm of a tetrafunctional vinyl addition monomer cross-linking agent, wherein the microcapsule comprises a shell encapsulating a material having an average C log P of at least 2.5 and more than 60% by weight of the material has a C log P of at least 3.3.

DETAILED DESCRIPTION OF THE INVENTION

Without wishing to be bound by theory, fabric softening compositions containing microcapsules typically dispersed either tend to agglomerate, sediment or cream under certain conditions. Further, interaction of microcapsules with vesicles of cationic actives (e.g., vesicles containing di-tail ester quaternary ammonium compounds), tend to minimize the dispersion and effectiveness of uniform deposition. Many factors influence the stability and uniform deposition of microcapsule these include surface charge, rheology, yield stress and structuring of the system. As the microcapsules may be coated, increases in cationicity of the capsules due to an increase in available cationic charge. The deposition aid polymer of the present invention may help stabilize these capsules and/or enhanced deposition due to interaction with capsules. Not wishing to be bound by theory, the high charge content minimizes the self association of microcapsules and interaction with adjacent vesicles allowing better distribution of particles, stability, uniform and an increased deposition.

As used throughout, ranges are used as a shorthand for describing each and every value that is within the range. Any value within the range can be selected as the terminus of the range. Percentages given below are percent of total weight unless otherwise indicated.

The present invention is related to the benefit that is provided by use of a cationic polymer in a composition containing microcapsules, in particular to microcapsules having an average C log P of at least about 2.5 with more than 60% by weight of the material having a C log P of at least 3.3. The addition of the cationic polymer to the composition increases the stability of the microcapsule in the composition compared to compositions lacking such cationic polymer.

Perfumes are known in the art and may include odoriferous materials which are able to provide a fragrance to consumer products and/or impart a fragrance to a substrate e.g., shampoos and conditioners treat hair laundry detergents and rinse cycle fabric softeners treat fabrics and clothes, glass cleaners treat glass and hard surfaces, colognes, soaps, deodorants, antiperspirants and shower gels treat skin and hair. Perfumes may also counteract malodors and/or provide a fragrance. The perfumes may be in liquid state at ambient temperature, although solid perfumes may also be useful. Perfumes may include aldehydes, ketones, esters and other chemicals and compounds known in the art, including natural, synthetic perfumes, and mixtures thereof. Perfumes useful for the present invention may have relatively simple compositions or may comprise complex mixtures of natural and synthetic chemical components, all of which are intended to provide an odor or fragrance in consumer products and/or to the substrate. It is understood in the present application that a perfume may be substituted with flavors known in the art, and that the term perfume, as used herein, also includes flavors. Generally, perfumes may be present in consumer products between 0.00001-10%.

Formulations of the invention may comprise unencapsulated fragrance materials in addition to any fragrance material present in the microcapsules.

Fragrance microcapsules are generally known in the art, see e.g., WO/2004016234, US 2005/0153 135, US 2005/0256027, US2004/0072719A1, US2004/0072720A1, US20040071742A1, US2004/0071746A1, U.S. Pat. No. 6,194,375, WO 02/074430A1, and U.S. Pat. No. 6,620,777. A fragrance microcapsule generally has a shell which encapsulates a perfume, and optionally other materials, such as solvents surfactants, hydrophobic polymers, and other materials known in the art. The shell may be considered to be made up of a tight collection of strands of polymer(s) and may have a diameter less than 1000 μm, and the shells may have a mean diameter in the range 1 to 500 μm, preferably 1 to 300 μm, more preferably 1 to 50 μm and most preferably 1 to 10 μm. The size of the shell may be modified by methods known in the art. Preferred sizes for the shell will depend upon their intended use.

The shell generally prevents leaching of the perfumes from the consumer product. The shell may also bind to substrates, and release the perfume under predetermined conditions, i.e., while fabric is being ironed, a fragrance microcapsule on the fabric bursts due to change in temperature, or while fabric is being worn, a fragrance microcapsule bursts due to friction, shearing, or other physical/mechanical stress caused by the movement of the wearer.

A microcapsule's shell may be made by any of the methods known in the art. The shell may be a polymer or resin known in the art. Shells comprised of polyurethane, polyamide, polyolefin, polysaccharide, protein, silicone, lipid modified cellulose, gums, polyacrylate, polyphosphate, polystyrene, and polyesters or combinations thereof may be suitable for use in the present invention. Preferred shells may be an aminoplast which is formed by the reaction of one of more amines known in the art with one or more aldehydes known in the art, such as formaldehyde. In a preferred embodiment, aminoplasts may be prepared by polycondensation. A preferred aminoplast may be a melamine-formaldehyde or urea-formaldehyde condensate, such as melamine resin or urea-formaldehyde resin Aminoplasts, preferably a melamine resin, may be used singularly or in combination with other suitable amides known in the art. Crosslinking agents known in the art (e.g. toluene diisocyanate, divinyl benzene, butane diol diacrylate), and secondary polymers known in the art. such as polymers and co-polymers of maleic anhydride. Aminoplasts may also be mixed resins of urea-formaldehyde, maleic anhydride copolymers, and melamine-formaldehyde.

The microcapsules of the present invention have a shell, the shell having an inner surface, and an outer surface. The inner surface and/or outer surface of the shell may be coated, e.g., with a polymer. The coating on the inner surface and/or outer surface may improve the barrier properties of the shell and thus may enhance retention of the encapsulated materials in surfactant-containing and/or solvent containing consumer products.

A cationically charged water-soluble polymer known in the art can be coated on shell. The water-soluble polymer can also be an amphoteric polymer with a ratio of cationic and anionic functionalities resulting in a net total charge of zero and positive. Methods for coating the cationically charged polymer onto the microcapsule are also known in the art.

The application of a coating to the inner surface of the shell capsules may be carried out by a number of methods known in the art. One approach known in the art involves the use of a suitable material for the coating which is insoluble in the material to be encapsulated, but can be dissolved in a water soluble solvent e.g., ethanol, carbitol, which is miscible with the material to be encapsulated. The coating material, typically a polymer, is dissolved in the solvent and then the solution is dissolved in the material to be encapsulated. The material to be encapsulated is then emulsified into a standard aminoplast capsule forming aqueous solution. As the emulsion forms, the solvent is lost to the water and the polymer precipitates out from solution at the surface of the emulsion droplets, forming a film at the interface of water/material to be encapsulated. An encapsulation process known in the art may then be carried out and the coating may be deposited on the inner surface of the shell.

In another method known in the art, a coating material e.g., silicone used may be immiscible with materials to be encapsulated and immiscible with water, and is capable of forming a thin film at the water interface. A shell encapsulate comprising a coating of silicone on the inner surface of the shell can be prepared by dispersing the material to be encapsulated within the silicone and then emulsifying this mixture so that an emulsion is formed where droplets of encapsulated material are surrounded by a thin film of silicone. The encapsulation process is then carried out as known in the art. Alternatively, a thin film may be formed at the surface by dispersing the material to be encapsulated in water adding the second material e.g., silicone and allowing it to coat the encapsulating material droplets subsequently. An inner surface coating may also be made from a film-forming polymer known in the art, for example: poly(ethylene-maleic anhydride), povidones, waxes e.g. carbowax. polyvinylpyrrolidone (PVP) and its co-polymers such as polyvinylpyrrolidone-ethyl acrylate (PVP-EA), polyvinylpyrrolidone-vinyl acrylate, polyvinylpyrrolidone methylacrylate (PVP-MA), polyvinylpyrrolidone/vinyl acetate polyvinyl acetal, polyvinyl butyral, polysiloxane, poly(propylene maleic anhydride), maleic anhydride derivatives and co-polymers of the above, e.g. polyvinyl methyl ether/maleic anhydride. Preferably, the inner wall coating comprises polysiloxane, PVP or PVP co-polymers, more preferably PVP or PVP co-polymers, and even more preferably PVP co-polymers, particularly PVP-MA or PVP-EA.

A coating may be applied to the outer surface of a shell techniques known in the art, such as by including spraying, fluid bed coating, or precipitating. For example a coating, e.g., of a polymer, may be precipitated from aqueous solution to condense onto the outer surface of the shell or microcapsule, e.g., in the form of a capsules slurry, with precipitation being caused by change of temperature, pH. addition of salt, and other variables and conditions known in the art. The shell capsule to be coated is thus formed in a separate first step, prior to the application of the coating to the outer surface of the shell wall. Depending on the composition of the outer surface coating, a coated shell capsule may be prepared for example, by coacervation or polycondensation.

The outer surface coating may comprise high molecular weight, film-forming polymers known in the art which may optionally be cross-linked "High molecular weight" is meant a molecular weight average of greater than 2000 Da. preferably greater than 4000 Da, more preferably greater than 5000 Da. The polymer maybe water-soluble or water-insoluble, preferably water-soluble. Suitable polymers for use may include, polyvinyl alcohol (PVOH), styrene-butadiene latex, gelatin, gum arabic, carboxymethyl cellulose, carboxymethyl hydroxyethyl cellulose, hydroxyethyl cellulose, other modified celluloses, sodium alginate, chitosan, casein, pectin, modified starch, polyvinyl acetal. polyvinyl butyral, polyvinyl methyl ether/maleic anhydride. PVP and its co-polymers (e.g. polyvinylpyrrolidone/vinyl acetate (PVP/VA). polyvinyl pyrrolidone/dimethylaminoethyl methacrylate) (PVP/DMAEMA), poly(vinyl pyrrolidone/methacrylamidopropyl trimethyl ammonium chloride), melamine-formaldehyde and urea-formaldehyde. Preferably the outer surface of the shell is coated with PVOH, PVP or a PVP co-polymer.

A preferred coated shell may be an aminoplast capsule having a coating of PVOH, PVP or a co-polymer PVP (preferably PVP/DMAEMA) on the outer surface of the shell and/or a coating of a film-forming polymer (preferably PVP-EP) on the inner surface.

The coating (inner and/or outer) may be cross-linked in any known manner, e.g., by interfacial cross-linking A shell capsule useful herein may have more than one coating on the outer surface of the shell.

Coated shell capsules typically have a wall thickness in the range of about 0.01 to about 30 μm, preferably about 0.01 to about 5 μm. more preferably about 0.03 to about 1 μm, most preferably about 0.03 to about 0.5 μm. The wall thickness may be regulated and controlled according to the encapsulate size and by varying the relative proportions of coating and shell polymer. The weight ratio of coating to shell wall is typically in the range of about 0.01 to about 10:1, preferably about 0.1:1 to about 10:1, more preferably about 0.1:1 to about 3:1.

Typically, the weight ratio of polymer shell wall material to encapsulated material is in the range of about 1:10 to about 3:2 and preferably in the range of about 1:10 to about 1:2. The coating on the inner surface and/or outer surface will increase these weight ratios.

When the shell is coated, materials having an average C log P value equal to or greater than 2.5 may be encapsulated, preferably within the range of about 3 to about 5. Materials used in uncoated microcapsules may include materials wherein at least about 60% have a C log P equal to or greater than about 3.3, preferably greater than about 4. By "average C log P" is meant the average C log P for all of the encapsulated materials. Thus the average C log P of the encapsulated materials may be raised, for example, by adding a solvent having a high C log P, e.g., about 6 or greater, wherein the solvent is miscible with the other encapsulated materials.

One or more perfumes may be used in the present invention as a mixture of perfumes. Thus, for microcapsules having a shell without a coating, a mixture of perfumes greater than about 60 weight percent of the fragrance materials have a C log P of greater than about 3.3, preferably more than about 80 weight percent of the fragrances have a C log P value of greater than about 4.0, and more preferably, more than about 90 weight percent of the fragrances have a C log P value of greater than about 4.5 may be used.

The microcapsule contains a core within the shell, and the core comprises a perfume or other benefit agent such as a flavorant or antibacterial material and may optionally contain other materials known in the art, for example, hydrophobic solvents such as triglyceride oil, mono and diglycerides, mineral oil, silicone oil, diethyl phthalate, polyalphaolefins, fatty alcohols castor oil and isopropyl myristate. The solvent materials may be miscible with the benefit agents. For microcapsules having a shell without a coating on the inner or outer surface, suitable solvents include those having reasonable affinity for the perfume and the solvent may have a C log P greater than 3.3, preferably greater than 6 and most preferably greater that 10. A preferred solvent may be isopropyl myristate. A preferred solvent may also be silicone such polydimethylsiloxane and polydimethylcyclosiloxane. In another embodiment of the present invention, a preferred solvent may be diethyl phthalate. The solvent may be greater than about 30 weight percent preferably greater than about 50 weight percent and more preferably greater than about 70 weight percent of the core.

It is known in the art that the addition of hydrophobic polymers in a microcapsule may also improve stability of the microcapsule by slowing diffusion of the perfume from the shell. The amount of the hydrophobic polymer may be less than 80% of the microcapsule by weight, preferably less than 50%, and most preferably less than 20%. A hydrophobic polymer may be ethyl cellulose, hydroxypropyl cellulose, cellulose acetate butyrate, ethylene vinyl acetate, polystyrene and PVP and ester terminated polyamides or amide terminated polyamides.

As previously described, when microcapsules are incorporated in certain solvents and/or surfactant-containing consumer products e.g., shampoos, stability problems may arise. Thus in the present invention, a cationic polymer is added to the consumer product to increase the stability of the microcapsule. Moreover the cationic polymer improves the deposition of the encapsulates on the surfaces being treated and/or improves the release of the perfume raw materials.

The cationic polymer in the present invention is a cross-linked polymer. The cross-linking agent contains at least three, four, or more ethylenically unsaturated moieties. In one embodiment, the cross-linking agent contains at least four ethylenically unsaturated moieties. A preferred cross-linking agent is tetra allyl ammonium chloride.

The cationic polymer may be a cationic vinyl polymer. A cationic vinyl polymer may be derived from the polymerization of from about 5 to 100 mole percent of a cationic vinyl addition monomer and 0 to about 95 mole percent of acrylamide. The tetrafunctional vinyl addition monomer may be a polyethylene glycol diacrylic ester having a weight average molecular weight of from 300 to 3,000.

The cationic polymer may be derived from the polymerization of about 5 to 100 mole percent of a cationic vinyl addition monomer, 0 to about 95 mole percent of acrylamide, and about 0.5 to about 500 ppm of a tetrafunctional vinyl addition monomer crosslinking agent. The cross linker(s) is (are) included in the range of from 5 ppm to 500 ppm, alternatively from 10 ppm to 400 ppm, more preferred 20 ppm to 200 ppm even more preferred 40 ppm to 100 ppm, even more preferred from 50 ppm to 80 ppm. In one embodiment, the cross linker is greater than 5 ppm.

The cationic polymer may also be a cross-linked cationic vinyl addition polymer derived from the polymerization of about 15 to about 70 mole percent of a quaternary ammonium salt of dimethyl/aminoethylmethacrylate and about 30 to about 85 mole percent of acrylamide, and about 0.005 to about 0.025 weight percent of the polyethylene glycol diacrylic ester. The polyethylene glycol diacrylic ester may be polyethylene glycol dimethacrylate.

In yet still another embodiment of the invention, the polymer comprises 50-70 wt-%, preferably 55-65 wt-%, of at least one cationic monomer and 30-50 wt-% preferably 35-45 wt-%, of at least one non-ionic monomer. The weight percentages relate to the total weight of the copolymer.

In one embodiment, cationic monomers are diallyl dialkyl ammonium halides or compounds according to formula (I):

(I)

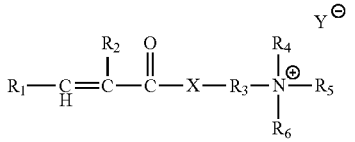

wherein:

$R_1$ is chosen from hydrogen or methyl, preferably hydrogen;

$R_2$ is chosen hydrogen, or $C_1$-$C_4$ alkyl, preferably $R_2$ is chosen from hydrogen or methyl;

$R_3$ is chosen $C_1$-$C_4$ alkylene, preferably ethylene;

$R_4$, $R_5$, and $R_6$ are each independently chosen from hydrogen, or $C_1$-$C_4$ alkyl, preferably methyl;

X is chosen from —O—, or —NH—, preferably —O—; and

Y is chosen from Cl, Br, I, hydrogensulfate or methosulfate, preferably Cl.

The alkyl groups may be linear or branched. The alkyl groups are methyl, ethyl, propyl, butyl, and isopropyl.

In one embodiment, the cationic monomer of formula (I) is dimethyl aminoethyl acrylate methyl chloride.

In one embodiment, the non-ionic monomers are compounds of formula (II) wherein (II)

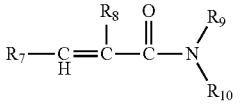

wherein:

$R_7$ is chosen from hydrogen or methyl, preferably hydrogen;

$R_8$ is chosen from hydrogen or $C_1$-$C_4$ alkyl, preferably hydrogen; and $R_9$ and $R_{10}$ are each independently chosen from hydrogen or $C_1$-$C_4$ alkyl, preferably $R_9$ and $R_{10}$ are chosen from hydrogen or methyl.

In one embodiment, the non-ionic monomer is acrylamide.

The cross-linking agent contains four ethylenically unsaturated moieties, i.e., is tetrafunctional. In one embodiment the cross lining agent contains 3, 4, 5, or more ethylenically unsaturated moieties A suitable cross-linking agents may include tetra allyl ammonium chloride. It is also suitable to use mixtures of cross-linking agents.

The crosslinker(s) is (are) included in the range of from 0.5 ppm to 500 ppm, alternatively from 10 ppm to 400 ppm, more preferred 20 ppm to 200 ppm even more preferred 40 ppm to 100 ppm, even more preferred from 50 ppm to 80 ppm of the polymer In one embodiment, the cross linker is greater than 5 ppm.

The chain transfer agent is chosen from mercaptanes, malic acid, lactic acid, formic acid, isopropanol and hypophosphites, and mixtures thereof. In one embodiment, the CTA is formic acid.

The CTA is present in a range greater than 100 ppm. In one embodiment, the CTA is from 100 ppm to 10,000 ppm, alternatively from 500 ppm to 4,000 ppm, alternatively from 1,000 ppm to 3,500 ppm, alternatively from 1,500 ppm to 3,000 ppm, alternatively from 1,500 ppm to 2,500 ppm, alternatively combinations thereof. In yet another embodiment the CTA is greater than 1000. It is also suitable to use mixtures of chain transfer agents.

The cationic polymer may be prepared as water in oil emulsions, wherein the cross-linked polymers are dispersed in the oil, preferably a mineral oil. A cationic polymer may be a cross-linked copolymer of a quaternary ammonium acrylate or methacrylate in combination with an acrylamide comonomer. Additional description of cationic polymers useful in the present invention may be found in U.S. Pat. Nos. 4,806,345 and 6,864,223.

In another embodiment, the cationic polymer in present invention is a homopolymer of formula (Ia)

(Ia)

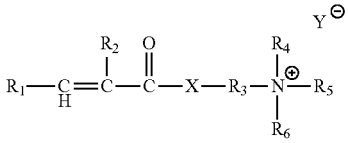

Wherein:

$R_1$ is chosen from hydrogen or methyl, preferably hydrogen;

$R_2$ is chosen hydrogen, or $C_1$-$C_4$ alkyl, preferably methyl;

$R_3$ is chosen $C_1$-$C_4$ alkylene, preferably ethylene;

$R_4$, $R_5$, and $R_6$ are each independently chosen from hydrogen, or $C_1$-$C_4$ alkyl, preferably methyl;

X is chosen from —O—, or —NH—, preferably —O—; and

Y is chosen from Cl, Br, I, hydrogensulfate or methosulfate, preferably Cl.

The cross-linking agent selected from divinyl benzene; tetra allyl ammonium chloride; allyl acrylates and methacrylates; diacrylates and dimethacrylates of glycols and polyglycols; butadiene; 1,7-octadiene; allyl-acrylamides and allylmethacrylamide; bisacrylamidoacetic acid; N,N'-methylene bisacrylamide and polyol polyallylethers. Most preferred cross-linking agent combination of tetra allyl ammonium chloride and diacrylate where preferred amount tetra allyl ammonium from 100 to 400 ppm, most preferred from 120 to 300 ppm and most preferred diacrylate 500 to 700 ppm.

Optionally at least one charin transfer agent selected from mercaptanes; malic acid; lactic acid; formic acid; isopropanol and hypophosphites in an amount of 0-10000 ppm, preferably 100-5000 ppm, more 300-3000, the amount of cross-linking agent A composition may comprise about 0.001% to about 40% total weight of the cationic polymer, preferably about 0.01% to about 10%, more preferably, about 0.01% to about 5%. The amount of cationic polymer present will depend upon the composition and the microcapsule used therein. The cationic polymer may be admixed to the consumer product before, during or after the addition of a microcapsule to the consumer product.

As described herein, the cationic polymer is well suited for use in a variety of well-known consumer products comprising a microcapsule, such as oral care products, toothpastes, mouthwashes, personal care products, lotions, creams, shampoos conditioners, hair gel, antiperspirants, deodorants, shaving creams, hair spray, colognes, body wash, home care products, laundry detergent, fabric softeners, liquid dish detergents, tumble dryer sheets, automatic dish washing detergents, and hard surface cleaners. These consumer products may employ surfactant, solvents and emulsifying systems that are well known in the art. In the consumer product base, a fragrance is used to provide the consumer with a pleasurable fragrance during and after using the product or to mask unpleasant odors from some of the functional ingredients used in the product. As stated above, a problem with the use of encapsulated fragrance in product bases is the loss of the fragrance before the optimal time for fragrance delivery.

In the present invention, the microcapsule may be in an aqueous solution of a consumer product. Alternatively, the microcapsule may be in the continuous phase of an oil-in-water emulsion of a consumer product. Alternatively, the microcapsule may be in the discontinuous phase of an oil-in-water emulsion of a consumer product. Alternatively, the microcapsule may be in the discontinuous phase of a water-in-oil emulsion of a consumer product. Alternatively, the microcapsule may be in the continuous phase of a water-in-oil emulsion of a consumer product.

Consumer products may be made using an aqueous base containing a surfactant, although some products use glycols polyhydric alcohols, alcohols, or silicone oils as the dominant solvent or carrier. Suitable surfactant agents for use in the present invention include those surfactants that are commonly used in consumer products such as laundry detergents, fabric softeners and the like. The products commonly include cationic surfactants which also are used as fabric softeners; as well as nonionic and anionic surfactants which are known in the art. Surfactants are normally present at levels of about 1 to 30 weight %. In some instances the surfactant loading may be more than 85, typically more than 95 and greater than about 99 weight % of the formulated product.

The present invention is further illustrated for use in a consumer product, such as a fabric softener composition. Fabric softener compositions are known in the art, and contain a fabric softening component, and other optional materials such as perfumes, chelators, preservatives, dyes, soil release polymers, and thickeners. Other optional ingredients may also include solvents, alcohols, amphoteric and nonionic surfactants, fatty alcohols, fatty acids, organic or inorganic salts, pH buffers, antifoams, germicides, fungicides, antioxidants, corrosion inhibitors, enzymes, optical brighteners antifoams, and other materials known in the art.

A fabric softener composition may be substantially free of anionic surfactants known in the art, such as lithium dodecyl sulfate, or sodium dodecyl sulfate. By substantially free is meant that the fabric softener composition contains less than 5% weight of anionic surfactant, preferably less than 1% by weight, more preferably less than 0.5% by weight and still more preferably less than 0.1 by weight of an anionic surfactant.

A fabric softener composition may be substantially free of water soluble builder salts known in the art such as alkali metal phosphates, such as sodium phosphate and potassium phosphate. By substantially free is meant that the fabric softener composition contains less than 5% weight of a builder salt, preferably less than 1% by weight, more preferably less than 0.5% by weight and still more preferably less than 0.1% by weight an water soluble builder salt.

Fabric softening components in fabric softener compositions are well known in the art. and may include cationic surfactants, quaternary ammonium salts (acyclic quaternary ammonium salts, ester quaternary ammonium salts cyclic quaternary ammonium salts, diamido quaternary ammonium salts, biodegradable quaternary ammonium salt, polymeric ammonium salts), polyquats, tertiary fatty amines carboxylic acids, esters of polyhydric alcohols, fatty alcohols, ethoxylated fatty alcohols, alkylphenols. ethoxylated alkylphenols, ethoxylated fatty amines, difatty. ethoxylated monoglycerides, ethoxylated diglycerides, mineral oils, clays, and polyols.

A fabric softener composition may comprise about 0.01% to about 35% by weight of one or more fabric softening components. Preferably, the present invention may comprise about 0.5% to about 25% weight of a fabric softening component. Optionally, the present invention may comprise about 1.5% to about 12% of a fabric softening component. Optionally, the present invention may comprise about 15% to about 24% of a fabric softening component.

The amount of the components in a fabric softener composition will depend on the purpose of the formulation, i.e., whether the formulation concentrated or dilute. Thus the fabric softening component may, for example, be about 0.1% to about 50% of the total weight of the composition, e.g. about 10% to about 25% for a concentrated composition and about 1 to about 10% for a dilute composition. The fabric softener composition may also have one or more chelators, dyes fatty alcohols preservatives and/or perfumes, and/or other ingredients as known in the art.

Process of Improving the Performance of Microcapsules

A process of improving the performance of a population of core shell microcapsules having a negative zeta potential comprising adding a sufficient amount of cationic polymer to said population of microcapsules to provide said population of microcapsules with a positive zeta potential and then combining said population of microcapsules with a second component to form a fabric softener composition and/or laundry detergent is disclosed.

In one aspect of said process, said process comprises adjusting the pH of the population of microcapsules to a range of 1 to 5, preferably 2 to 4, most preferably 2.5 to 3.5 prior to adding said cationic polymer, optionally, prior to adjusting said pH, diluting the population of microcapsules to provide said population of microcapsules with a viscosity of from about mPa s 1 to about mPa s 2000, preferably from about 20 mPa s to about 200 mPa s.

In one aspect of said process, said population of microcapsules is contained in a slurry.

In one aspect of said process, said slurry comprises, based on total slurry weight, 35% microcapsules.

In one aspect of said process, said shell comprises a material selected from the group consisting of polyethylenes, polyamides, polystyrenes, polyisoprenes, polycarbonates, polyesters, polyacrylates, polyureas, polyurethanes, polyolefins, polysaccharides, epoxy resins, vinyl polymers, and mixtures thereof, preferably said shell comprises melamine formaldehyde and/or polyacrylates and the core comprises perfume raw materials, silicone oils, waxes, hydrocarbons, higher fatty acids, essential oils, lipids, catalysts, bleach particles, silicon dioxide particles, malodor reducing agents, dyes, brighteners, antibacterial actives, cationic polymers and mixtures thereof, preferably said core comprises perfume raw materials.

In one aspect of said process, at least 75%, 85% or even 90% of said microcapsules may have a particle wall thickness of from about 60 nm to about 250 nm, from about 80 nm to about 180 nm, or even from about 100 nm to about 160 nm In one aspect of said process, said population of microcapsules may comprise, based on total microcapsule weight, from about 20 weight % to about 95 weight %, from about 50 weight % to about 90 weight %, from about 70 weight % to about 85 weight %, or even from about 80 weight % to about 85 weight % of a perfume composition.

In one aspect of said process, said population of microcapsules may have a core/wall ratio can range from 80/20 up to 90/10 and average particle diameter can range from 5 μm to 50 μm.

Examples

Synthesis of the Cationic Polymer

This non-limiting example illustrates the preparation of a suitable cationic polymer. An 'aqueous phase' of water soluble components is prepared by admixing together the following components:

- 167.31 g of acrylamide or N,N-dimethylacrylamide;
- 250.97 g of methyl chloride quaternized dimethylamino ethyl acrylate;
- 0.64 g of sequesterant;
- 0.14 g of potassium bromate;
- the 2000 ppm of formic acid as the chain transfer agent; and
- 55 ppm of tetraallyl ammonium chloride as crosslinker The aqueous phase is deoxygenated by nitrogen gas for 20 minutes.

A continuous 'oil phase' is prepared by admixing together with 370 g of Exxsol® D100 (dearomatised hydrocarbon solvent), which contains non-ionic emulsifier. The continuous phase is deoxygenated by nitrogen gas for 20 minutes.

The monomer solution is then added to the continuous phase and emulsified with a homogenisator. The temperature of the emulsion is adjusted to 25° C. The mixture is initiated by addition of 0.14 g Sodium bisulphite (2.4% vol/vol solution).

When the exothermic reaction is completed, a water-in-oil emulsion is formed. The emulsion polymer has an average particle size of about 200 nm.

A suitable way to measure molecular weight is using flow field-flow fractionation, Eclipse 2, Multi Light Scattering detector Dawn Eos, and concentration detector R.I. Optilab DSP (Wyatt) (Spacer 350 μl; Injection pump 0.2 ml/min; Nadir 10 kD Reg. Cel. Membrane). The polymer is isolated from the emulsion as a powder and then redissolved in water (3 g/l). The solution is diluted further to 0.3 g/l using 0.5M NaCl solution. Finally, 50 μl of the sample is filtered through 5 μm filter before then injected to flow field-flow fractionation, the multi-angle laser light-scattering with dn/dc 0.150 ml/g.

Test Methods

Method for Determining Headspace Ratio

Dynamic headspace (vapor phase) sampling above treated fabrics enables detection and quantitation of perfume volatiles. Basically, the volatiles present in the headspace above fabrics are collected on a Tenax-TA sorbent trap in a controlled (known headspace volume, sampling flow rate, temperature and pressure) manner. This is achieved by either displacing the vapor phase with an inert gas-stream (e.g. helium) or by means of a headspace sampling pump, to trap volatiles on the sorbent medium. Subsequently, the trapped volatiles are on-line thermally desorbed into the injection-port of a GC and cryo-focussed. Finally, the headspace-extracts are analyzed by capillary GC hyphenated to mass spectrometry.

A technology leg needs to be analyzed in parallel with a nil-technology fabric (reference), containing equal perfume levels.

Method Details:

- About 40 g of fabric is placed in a closed headspace vessel of 1 L and stored at ambient conditions overnight.
- 2 L of headspace is collected (40 min at 50 ml/min flow rate) onto the Tenax-TA trap at ambient conditions (known temperature, pressure)
- Thermally desorb trap at 180° C. for 10 minutes into the injection-port of GC
- Run GC-MS analysis: GC separation on apolar stationary phase, followed by mass spectrometry in full scan mode (70 eV)
- The headspace responses (full scan and/or SIM MS based) of each perfume component in the applied perfume oil, are monitored for both technology and nil-technology leg. The headspace ratio, for each perfume component, is defined as the headspace of the perfume compounds delivered by the technology divided by the headspace of the perfume compounds delivered without the technology.

The average overall headspace ratio for a benefit agent particle delivery is defined as the sum of the headspace ratios for each of the core's benefit agents divided by the total number of the core's benefits.

Method for Determining Deposition of Perfume Encapsulate on Fabrics

Description of the Method:

Deposition measurement of perfume encapsulates on fabric is based upon microwave digestion of encapsulates in a specific solvent followed by flow injection mass spectrometry (multiple reaction monitoring-MRM). Specific PRM's with a high C log P and high boiling point are used as tracers for calculation of deposition of the encapsulates on fabric.

About 2.5 gram fabric is transferred in a 100 mL glass bottle. After addition of 50 mL methanol, the glass bottle is put in a microwave oven, operated at 800 W for 30 seconds. In this time frame, microcapsules deposited on the fabric burst and release the PRM's into the methanol solution. After subsequent dilution in methanol, a sample aliquot is analysed by flow injection MS/MS. For quantitation of the high C log P PRM's a calibration curve is made by analyzing increasing amounts of neat perfume oil in the concentration range of interest under the same MRM conditions.

Instrument conditions: API 3000 operated in APCi mode. Methanol is used as eluens at a flow rate of 200 uL/min. The instrument is tuned for optimal sensitivity according to the supplier guidelines and specific MRM transitions are used for each analyte of interest. The specific MRM transitions are defined, prior to analysis of samples, by infusion of a selected number of PRM's into the MS.

Examples

The following are non-limiting examples of the fabric care compositions of the present invention.

| | (% wt) | | |
|---|---|---|---|
| | I | II | III |
| FSA[a] | 9.1 | 9.1 | 9.1 |
| FSA[b] | — | | |
| FSA[c] | — | | |
| Low MW alcohol | 0.90 | 0.90 | 0.90 |
| Rheology modifier[d] | 0.13 | — | — |
| Perfume | 0.80 | 0.80 | 0.80 |
| Perfume encapsulation | 0.26 | 0.26 | 0.26 |
| Calcium Chloride | 0.02 | 0.02 | 0.02 |
| NaHEDP[e] | 0.0071 | 0.0071 | 0.0071 |
| Preservative[f] | 0.0075 | 0.0075 | 0.0075 |
| Antifoam[g] | 0.0081 | 0.0081 | 0.0081 |
| CAAd-base as separate ingredient[h] | — | — | 0.065 |
| Rheovis CDE coated on perfume encapsulates prior to addition into finished product[i] | | 0.13 | |
| PDMS emulsion[j] | 0.72 | 0.72 | 0.72 |
| Dye (ppm) | 109 | 109 | 109 |
| HCl | 0.014 | 0.014 | 0.014 |
| Deionized Water | Balance | Balance | Balance |

[a]N,N-di(tallowoyloxyethyl)-N,N-dimethylammonium chloride.

[b]Methyl bis(tallow amidoethyl)2-hydroxyethyl ammonium methyl sulfate.

[c]Reaction product of Fatty acid with Methyldiethanolamine in a molar ratio 1.5:1, quaternized with Methylchloride, resulting in a 1:1 molar mixture of N,N-bis(stearoyl-oxy-ethyl) N,N-dimethyl ammonium chloride and N-(stearoyl-oxy-ethyl) N,-hydroxyethyl N,N dimethyl ammonium chloride.

[Z]The Reaction product of fatty acid with an iodine value of 40 with methyl/diisopropylamine in a molar ratio from about 1.86 to 2.1 fatty acid to amine and quaternized with methyl sulfate.

[d]Cationic polymer available from Ciba under the name Rheovis CDE.

[e]Sodium Hydroxyethane diphosphonic acid.

[f]Proxel available from Arch chemicals"

[g]Silicone antifoam agent available from Dow Corning Corp. under the trade name MP10.

[h]Cationic acrylate acrylamide copolymer ???.

[i]Cationic methyl chloride quaternized dimethylamino ethyl Methacrylate ???

[j]Polydimethylsiloxane emulsion from Dow Corning under the trade name DC346.

Coating Perfume Encapsulates with Cationic Polymer

A method to coat perfume encapsulate slurries with a cationic polymer is described. At first, the slurry is diluted 5× with demineralized water and the pH is adjusted to 3.0 with HCl. This is needed to decrease the surface charge density as a too high charge density would result in a less efficient coating.

This diluted slurry is then mixed with a propeller mixer with a small visible vortex and the cationic polymer is slowly (drop-by-drop) added. At this point all added Cationic polymer is going directly to the negatively charged perfume encapsulate surface. The zeta potential of the perfume encapsulate is increasing and will slowly go towards 0 mV. When close to 0 mV, big aggregates are formed and a full phase separation occurs. When more cationic polymer is added, the net surface charge will become positive. At this point, the phase separated aggregates will re-disperse and the perfume encapsulates will be fully coated with the cationic polymer.

Example: 200 g of dilute slurry coated with cationic methyl chloride quaternized dimethylamino ethyl Methacrylate 1. 144.20 g of deionized water
2. Add 39.17 g of perfume encapsulate slurry while mixing using an IKA bench top mixer
3. Add 8.88 g of HCl acid solution (2.5% w/w active in deionized water) while mixing using an IKA bench top mixer
4. Add 7.75 g of cationic methyl chloride quaternized dimethylamino ethyl Methacrylate emulsion in oil (E.g. Rheovis CDE ex. Wacker) slowly during mixing
5. At the zero charge point insoluble aggregates are formed, increase the mixer speed to ensure adequate mixing
6. Keep adding Rheovis CDE until the aggregates are redispersed Addition of Benefit Agent to the Fabric Softener Finished Product The benefit agent (cationic polymer) can be added as an additional ingredient with the perfume encapsulates or it can first be coated onto perfume encapsulates prior to addition to the fabric softener.

Full Scale Testing of Fabric Softener Products in Front Loader Washing Machines and Top Loader Washing Machines The front loader washing machines are used for wash conditions typical for Western European consumer conditions:

- Miele washing machines (Novotronic W986)
- Ballast load consisting out of muslin cotton, knitted cotton, polycotton and tufted polyester. Total ballast load weight is 2.5 kg
- Test fabrics are consisting of 10 terry tracers (cotton towels)
- An unperfumed Aria compact liquid detergent (70 ml) is used in the example below.
- The fabric softener is added in the last rinse at 35 ml reco dosage
- The test tracers are dried during 24 hours at 25° C. and 50% relative humidity.

The top loader washing machines are used for wash conditions typical for Northern American consumer conditions:

- Kenmore FS washing machines
- Ballast load consisting out of muslin cotton, knitted cotton, polycotton and tufted polyester. Total ballast load weight is 2.5 kg
- Test fabrics are consisting of 10 terry tracers (cotton towels)
- An unperfumed Tide liquid 2× detergent (51 ml) is used in the example below.
- The fabric softener is added in the last rinse at 43 ml dosage
- The test tracers are dried during 24 hours at 25° C. and 50% relative humidity.

Assessment of headspace (HS) ratio of products containing benefit agent versus products without benefit agent. Fabrics were analyzed after drying using the method for determination of headspace ratio (described above). The results of this experiment are summarized in Table 1 below:

TABLE 1

| Average HS ratio vs. Example I | | | | |
|---|---|---|---|---|
| | WE | | US | |
| | Example II | Example III | Example II | Example III |
| Dry fabric odor (post-mechanical friction) | 1.7x | 0.8x | 3.0x | 1.7x |
| Dry fabric odor (pre-mechanical friction | 1.3x | 1.0x | 2.0x | 1.3x |

Table 1: Average measured headspace ratio of fabrics rinsed with Example II and Example III fabric softener formulations containing benefit agents compared with fabrics rinsed with Example I without benefit agent.

Assessment of deposition of perfume encapsulates on fabric of products containing benefit agent versus products without benefit agent. Fabrics were analyzed after drying using the method for perfume encapsulate deposition on fabrics (described above). The results of this experiment are summarized in Table 2 below:

TABLE 2

| Average deposition ratio on cotton tracers vs. Example I | | | |
|---|---|---|---|
| WE | | US | |
| Example II | Example III | Example II | Example III |
| 1.0x | 1.4x | 1.0x | 1.7x |

Graph 2: Average measured deposition of perfume encapsulate ratio of fabrics rinsed with Example II and Example III fabric softener formulations containing benefit agents compared with fabrics rinsed with Example I without benefit agent.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern."

"While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A composition comprising: (a) a microcapsule comprising a shell encapsulating a material having an average C log P of at least about 2.5 and more than 60% by weight of the material has a C log P of at least 3.3, and (b) at least one polymer formed from the polymerisation of:

(i) a water soluble ethylenically unsaturated monomer or blend of monomers comprising at least one cationic monomer and at least one non-ionic monomer;

wherein the cationic monomer is a compound according to formula (I):

(I)

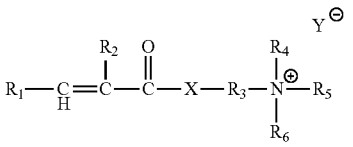

wherein:

$R_1$ is chosen from hydrogen or methyl;

$R_2$ is chosen hydrogen, or $C_1$-$C_4$ alkyl;

$R_3$ is chosen $C_1$-$C_4$ alkylene;

$R_4$, $R_5$, and $R_6$ are each independently chosen from hydrogen, or $C_1$-$C_4$ alkyl;

X is chosen from —O—, or —NH—; and

Y is chosen from Cl, Br, I, hydrogensulfate, or methosulfate;

wherein the non-ionic monomer is a compound of formula (II):

(II)

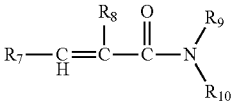

wherein:

$R_7$ is chosen from hydrogen or methyl;

$R_8$ is chosen from hydrogen or $C_1$-$C_4$ alkyl; and $R_9$ and $R_{10}$ are each independently chosen from hydrogen or $C_1$-$C_4$ alkyl;

at least one cross-linking agent in an amount from 5 ppm to 500 ppm by the weight of component a), and at least one chain transfer agent in the amount of 2000 ppm to 5000 ppm relative to component a);

(ii) optionally, a water soluble homopolymer of formula (Ia)

(Ia)

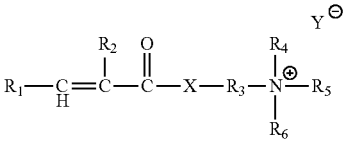

Wherein:

$R_1$ is chosen from hydrogen or methyl;

$R_2$ is chosen hydrogen, or $C_1$-$C_4$ alkyl;

$R_3$ is chosen $C_1$-$C_4$ alkylene;

$R_4$, $R_5$, and $R_6$ are each independently chosen from hydrogen, or $C_1$-$C_4$ alkyl;

X is chosen from —O—, or —NH—, preferably —O—; and

Y is chosen from Cl, Br, I, hydrogensulfate or methosulfate.

2. The composition of claim 1, wherein the component a) comprises 50-70 wt-% of the non-ionic monomer.

3. The composition of claim 1, wherein the cross-linking agent contains contain at least three or more ethylenically unsaturated moieties.

4. The composition of claim 1, wherein the chain transfer agent is formic acid.

5. The composition of claim 1, wherein the fabric care composition comprises from 0.01% to 0.3% of the polymer by weight of the fabric care composition.

6. The composition of claim 1, wherein the pH is from 2 to 5.

7. The composition of claim 1, further comprising 1% to 49% of a quaternary ammonium comprising fabric softening active.

8. The composition of claim 1, wherein the shell has an inner surface and an outer surface and the shell has a coating of a polymer film on the inner surface the outer surface or both the inner surface and the outer surface.

9. The composition of claim 8, wherein the inner surface has the coating with the polymer film.

10. The composition of claim 1, wherein the shell comprises an aminoplast.

11. The composition of claim 10, wherein the amnioplast comprises a resin of melamine and formaldehyde.

12. The composition of claim 10, wherein the polymer is selected from the group consisting of poly(ethylene-maleic anhydride), polyamine, wax, polyvinylpyrrolidone, polyvinylpyrrolidone co-polymers, polyvinylpyrrolidone-ethyl acrylate, polyvinylpyrrolidone-vinyl acrylate, polyvinylpyrrolidone methylacrylate, polyvinylpyrrolidone/vinyl acetate, polyvinyl acetal, polyvinyl butyral, polysiloxane, poly(propylene maleic anhydride), maleic anhydride derivatives, copolymers of maleic anhydride derivatives, and combinations thereof.

13. The composition of claim 1, wherein the shell comprises a mixed resin of urea-formaldehyde resin, maleic anhydride copolymers, and melamine resin.

14. The composition of claim 1, wherein the material has an average C log P value of equal to or greater than 3.3.

15. The composition of claim 1, wherein the outer surface has the coating of the polymer film comprising an outer polymer.

16. The composition of claim 15, wherein the outer polymer is selected from the group consisting of polyvinyl alcohol, styrene-butadiene latex, gelatin, gum Arabic, carboxymethyl cellulose, carboxymethyl hydroxyethyl cellulose, hydroxyethyl cellulose, other modified celluloses, sodium alginate, chitosan, casein, pectin, modified starch, polyvinyl acetal, polyvinyl butyral, polyvinyl methyl ether/maleic anhydride, polyvinyl pyrrolidone and its co polymers, poly (vinyl pyrrolidone/methacrylamidopropyl trimethyl ammonium chloride), polyvinylpyrrolidone/vinyl acetate, polyvinyl pyrrolidone/dimethylaminoethyl methacrylate, and combinations thereof.

17. The composition of claim 1, wherein the material comprises a fragrance material.

18. The composition of claim 1 further comprising in the microcapsule with the material a solvent having a C log P of at least 6 that is miscible with the material.

19. The composition of claim 1 further comprising at least one fabric softening component.

20. A composition according to claim 1 comprising:

a) a cross-linked cationic polymer derived from the polymerization of 5 to 100 mole percent of a cationic vinyl addition monomer 0 to 95 mole percent acrylamide, and 5 to 500 ppm of a tetrafunctional vinyl addition monomer cross-linking agent.

21. A process of making the composition of claim 1 comprising improving the performance of a population of core shell microcapsules having a negative zeta potential comprising adding a sufficient amount of cationic polymer to said population of microcapsules to provide said population of microcapsules with a positive zeta potential and then combining said population of microcapsules with a second component to form the composition of claim 1 said composition being a fabric softener composition and/or laundry detergent.

22. The process of claim 21 comprising adjusting the pH of the population of microcapsules to a range of 1 to 5, prior to adding said cationic polymer, optionally, prior to adjusting said pH, diluting the population of microcapsules to provide said population of microcapsules with a viscosity of from about mPa s 1 to about mPa s 2000.

23. The process of claim 22 wherein said population of microcapsules is contained in a slurry.

24. The process of claim 21 where said shell comprises a material selected from the group consisting of polyethylenes, polyamides, polystyrenes, polyisoprenes, polycarbonates, polyesters, polyacrylates, polyureas, polyurethanes, polyolefins, polysaccharides, epoxy resins, vinyl polymers, and mixtures thereof, and the core comprises perfume raw materials, silicone oils, waxes, hydrocarbons, higher fatty acids, essential oils, lipids, catalysts, bleach particles, silicon dioxide particles, malodor reducing agents, dyes, brighteners, antibacterial actives, cationic polymers and mixtures thereof.

25. A method of improving the stability of a product that comprises at least one microcapsule comprising admixing with the product a cross-linked cationic polymer derived from the polymerization of 5 to 100 mole percent of a cationic vinyl addition monomer, 0 to 95 percent acrylamide, and 5 to 500 ppm of a tetrafunctional vinyl addition monomer cross-linking agent, and has chain transfer agent from 2,000 to 5,000 ppm, wherein the microcapsule comprises a shell encapsulating a material having an average C log P of at least 2.5 and more than 60% by weight of the material has a C log P of at least 3.3.

* * * * *